US005088552A

United States Patent [19]

Raunio

[11] Patent Number: 5,088,552

[45] Date of Patent: Feb. 18, 1992

[54] METHOD OF CONSTRUCTING A HEAT EXCHANGER AND A HEAT EXCHANGER CONSTRUCTED BY USING THAT METHOD

[75] Inventor: Pentti Raunio, Riihimäki, Finland

[73] Assignee: Racert Oy, Riihimaki, Finland

[21] Appl. No.: 438,449

[22] PCT Filed: Jul. 7, 1988

[86] PCT No.: PCT/FI88/00111

§ 371 Date: Dec. 20, 1989

§ 102(e) Date: Dec. 20, 1989

[87] PCT Pub. No.: WO89/00671

PCT Pub. Date: Jan. 26, 1989

[30] Foreign Application Priority Data

Jul. 13, 1987 [FI] Finland ..... 873085

[51] Int. Cl.[5] ..... F28F 3/08

[52] U.S. Cl. ..... 165/166; 165/165

[58] Field of Search ..... 165/165, 166

[56] References Cited

U.S. PATENT DOCUMENTS

| | | | |
|---|---|---|---|
| 2,997,280 | 8/1961 | Keast | 165/166 |
| 3,148,442 | 9/1964 | Gier, Jr. | 165/166 |
| 4,157,929 | 6/1979 | Kubicek | 165/166 |
| 4,300,627 | 11/1981 | Cleveland et al. | 165/166 |
| 4,327,803 | 5/1982 | Muellejans et al. | 165/166 |
| 4,352,273 | 10/1982 | Kinsell et al. | 165/166 |
| 4,376,460 | 3/1983 | Skoog . | |
| 4,460,388 | 7/1984 | Fukami et al. | 165/166 |
| 4,668,443 | 5/1987 | Rye | 165/166 |
| 4,678,030 | 7/1987 | Almqvist . | |
| 4,688,629 | 8/1987 | Kohnken | 165/166 |
| 4,732,713 | 3/1988 | Korsell | 165/166 |
| 4,874,042 | 10/1989 | Becker | 165/166 |

FOREIGN PATENT DOCUMENTS

| | | | |
|---|---|---|---|
| 264659 | 9/1913 | Fed. Rep. of Germany . | |
| 2706090 | 8/1977 | Fed. Rep. of Germany . | |
| 60-256793 | 12/1985 | Japan . | |
| 343383 | 3/1972 | Sweden . | |
| 7203395 | 2/1975 | Sweden . | |
| 561071 | 12/1977 | U.S.S.R. . | |
| 673833 | 7/1979 | U.S.S.R. . | |
| 1241050 | 6/1986 | U.S.S.R. . | |
| 116786 | 6/1918 | United Kingdom . | |
| 517312 | 1/1940 | United Kingdom . | |
| 1229542 | 4/1971 | United Kingdom . | |
| 1430491 | 3/1976 | United Kingdom . | |
| 2028995 | 3/1980 | United Kingdom . | |
| 2047313 | 11/1980 | United Kingdom | 165/166 |
| 2161913 | 1/1986 | United Kingdom . | |

*Primary Examiner*—John Rivell
*Assistant Examiner*—L. R. Leo
*Attorney, Agent, or Firm*—Lorusso & Loud

[57] ABSTRACT

The invention concerns a method of constructing a heat exchanger as well as a heat exchanger constructed in accordance with said method. The method comprises piling of essentially similar corrugated thermal transmission plates to cover each other and connecting the spaces between the plates from their edges to inlet and outlet conduits for the mediums participating in thermal transmission so that through every second space between the plates is passed a flow of heat giving medium and through every second space between the plates a flow of heat receiving medium. Essential to the present invention is that the pressure losses of flows and the thermal transmission coefficient of the exchanger are established by piling the thermal transmission plates one over another so that the grooves in different plates are placed at a selected angle with each other. To make this possible the invention uses essentially circular thermal transmission plates or regular polygonal thermal transmission plates in which the direction of the grooves is such that the grooves in plates piled on top of each other may cross selectively at least in two different angles with each other.

8 Claims, 3 Drawing Sheets

Figure 1:
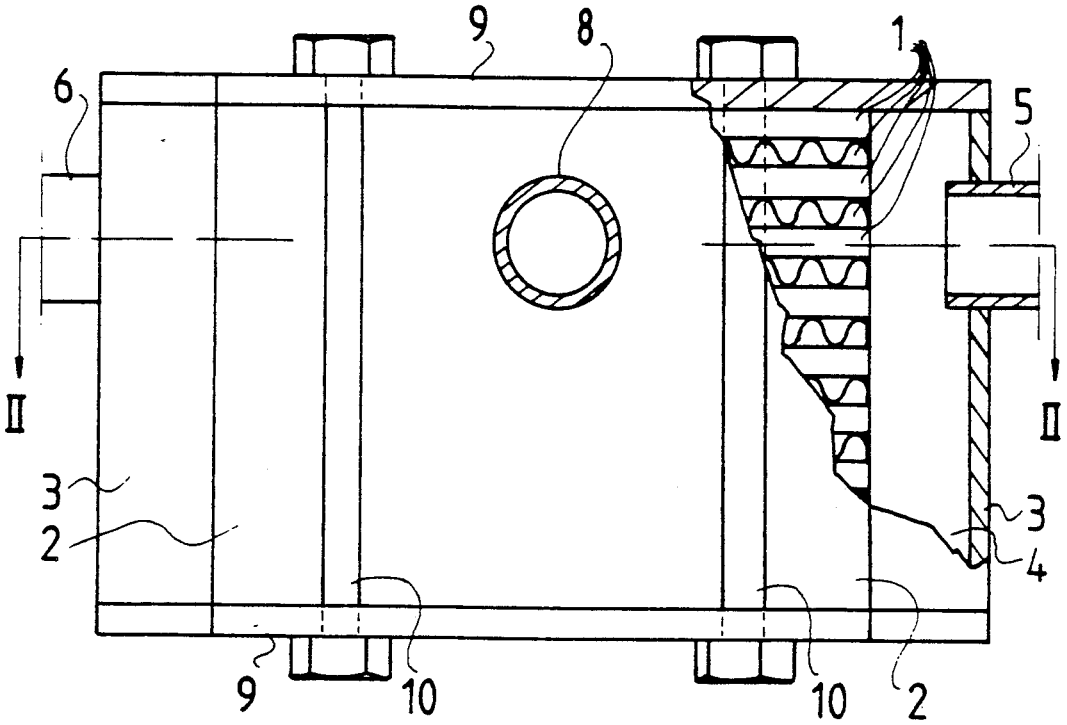

METHOD OF CONSTRUCTING A HEAT EXCHANGER AND A HEAT EXCHANGER CONSTRUCTED BY USING THAT METHOD

The object of the present invention is a method of constructing a heat exchanger, in which method essentially similar corrugated thermal transmission plates are piled to cover each other and the spaces between the plates are from their edges connected with inlet and outlet conduits for the mediums participating in thermal transmission, so that through every second space between the plates is passed a flow of heat giving medium and through every second space between the plates is passed a flow of heat receiving medium.

When there is a need to exchange heat between two flowing mediums plate type heat exchangers with plates piled one over another have been shown to be extremely effective. This type of heat exchangers are for example used in district heating systems where the heat transporting medium is water. In these heat exchangers using water can with a moderate pressure loss be achieved a thermal transmission coefficient in the range of about 2500–3500 W/m K.

The type of plate heat exchangers is known in which the plates lying on top of each other are square corrugated plates where the corrugations and the grooves between the corrugations have the direction of two opposite edges of the square. In this construction the plates are piled one over another so that the grooves in plates lying on top of each other are at an angle of 90° each other.

When constructing heat exchangers it is essential to choose the pressure losses of flowing mediums and their thermal transmission coefficient in view of achieving the wanted optimal thermal exchange. These parameters can be regulated by selection of the distance between individual thermal transmission plates, the surface area of the plates and corrugation of the plates. However, it happens in the known heat exchangers that as the dimensions of an individual plate have been resolved, at the same time the thermal transmission parameters at a selected level of the flow have been settled so that they cannot be changed any longer. In case there was a desire to change the thermal transmission characteristics of the heat exchanger it was necessary to select new dimensions for the plates according to the new demands. Thus for every different heat exchanger there was needed a specific deep drawing tool for the manufacture of the thermal transmission plates. As these tools are very expensive this thing has limited the possibilities of variations in heat exchanger manufacture.

The purpose of the present invention is to solve the above problem in heat exchanger manufacture. Characteristic for the method of constructing a heat exchanger according to the invention is that the thermal transmission plates are piled one over another so that grooves in different plates will become into a selected angle with each another, said angle defining the pressure losses of the flowing mediums as well as the thermal transmission coefficient for which purpose the method uses essentially circular thermal transmission plates, or regular polygonal thermal transmission plates in which the direction of the grooves is such that the grooves in plates piled on top of each other may cross selectively at least in two different angles with respect to each other.

The essential point in the present invention is that a suitable design of the thermal transmission plates enables piling of them on top of each other so that the grooves in different plates can become into two or more different angles to each other. This means that from identical plates made with one and the same tool different heat exchangers can be manufactured to which different angles between the grooves give different thermal transmission characteristics. The possibilities of variation in heat exchanger manufacture are thus very much improved without any notable increase in manufacturing costs.

In the present invention the most suitable are circular thermal transmission plates, which make it possible to choose the angle between the grooves in different plates from a continuous range of 0°–90°. However the basic idea of the invention also comes true when suitable regularly formed polygonal thermal transmission plates are used although in these cases the choice of different angles between the grooves is restricted.

When a heat exchanger is constructed according to the present invention the angle between the grooves in the heat transmission plates which are piled on top of each other determines the thermal transfer characteristics of the heat exchanger. The plates piled one over another can be welded or soldered at their edges together with each other to form a stationary heat exchanger unit, the parameters of which cannot be changed after this.

When the heat exchanger is assembled pairs of chambers which are open to every second space between the plates can be formed at the sides of the pile of plates in such way that the mediums participating in the thermal transmission may pass from the inlet conduits both through their respective chambers to the spaces between the plates and further through their respective chambers to the outlet conduits. Over and under the pile of plates can be placed end plates, which are fastened to each other by means of drawing rods.

Possibilities to vary the heat exchanger can be further enhanced by changing the mutual positions of the above-mentioned chambers. As the normal case can be considered a case in which the inlet and outlet chambers of the heat giving medium are placed diagonally opposite to each other and the inlet and outlet chambers of the heat receiving medium are as well diagonally on the opposite sides in 90° angle with the chambers of the heat giving medium. In the first place, a deviation from this can be made by choosing instead of the 90° angle some other arbitrary angle. In addition to this, it is possible to deviate the chambers from their diagonal position, it is, to put the inlet and outlet chambers of the heat giving and receiving mediums into some arbitrary, from 180° deviating angle to each other. By way of such variation, a crossflow heat exchange can be changed into the counterflow type so that utilization of the temperature difference between the heat giving and the heat receiving circuits is improved.

The present invention also concerns heat exchangers constructed in accordance with the method described in the above. The heat exchanger in accordance with the present invention comprises as previously known elements, essentially similar corrugated thermal transmission plates piled on top of each other and inlet and outlet conduits for the mediums participating in thermal transmission, said conduits being connected with the sides of the pile of plates so that through every second space between the plates may be passed a flow of heat giving medium and through every second space between the plates may be passed a flow of heat receiving medium. Essential for the heat exchanger is that the thermal transmission plates are either essentially circular and piled in such a way that the grooves in plates lying on top of each other are crossing each other or in the form of a regular polygon and piled to form a pile with flat sides so that the grooves in plates lying on top of each other form an angle which is larger than 0° but smaller than 90°.

Figure 2:
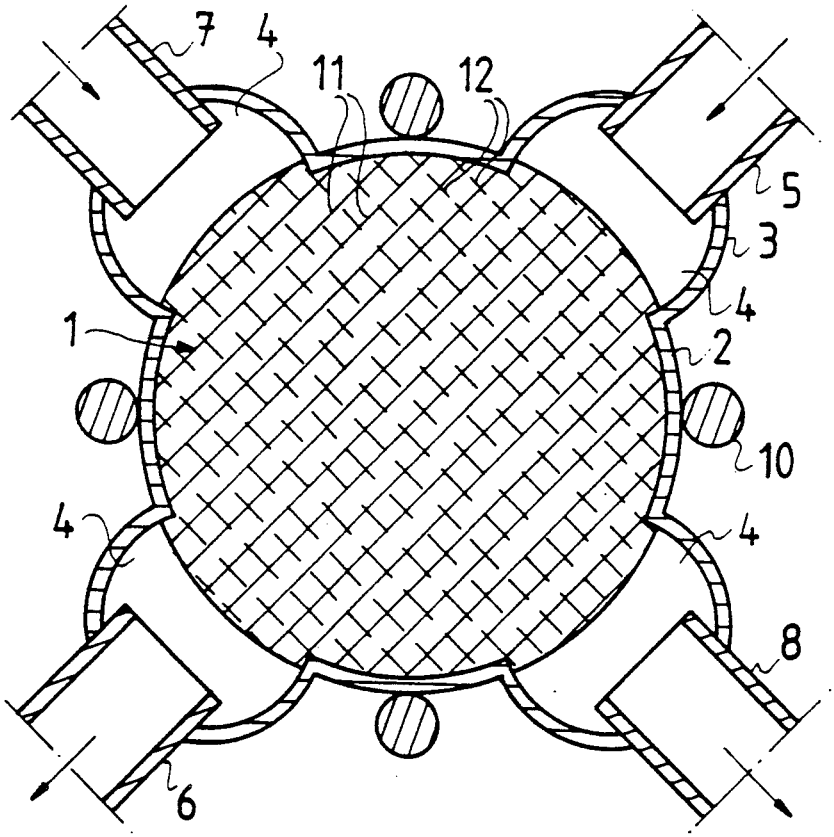
Figure 3:
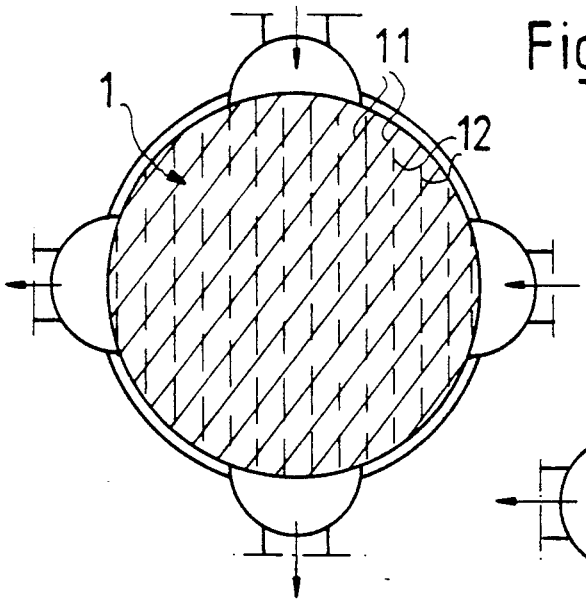
Figure 4:
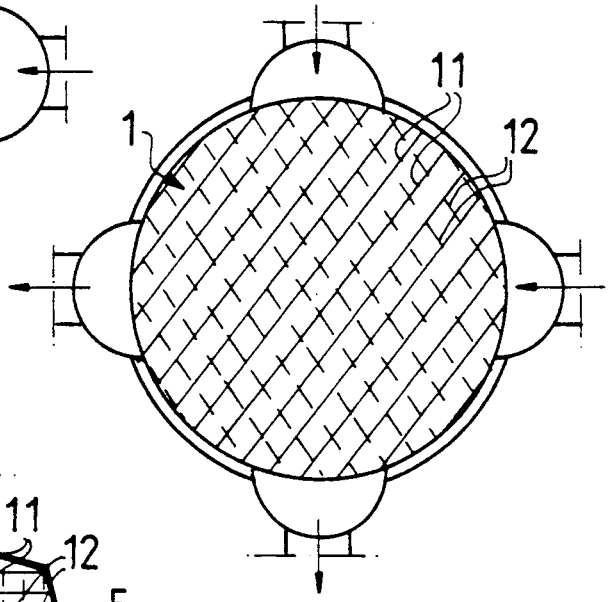

The present invention is explained in more detail in the following with the aid of examples and by referring to drawings in which FIG. 1 shows a heat exchanger according to the present invention seen from the side and partly cut open, FIG. 2 shows a heat exchanger according to FIG. 1 cut in line II—II in FIG. 1 (FIG. 2 has been turned horizontally 45°), FIGS. 3 and 4, show schematically two heat exchangers according to the present invention in which the grooves in the thermal transmission plates are in different angles with each other but which otherwise correspond to the heat exchangers shown in FIG. 1 and 2, FIGS. 5 and 6, show schematically two heat exchangers according to the present invention in which thermal transmission plates in the form of regular eight-angled polygons have their grooves in two different angles with each other.

Figure 7:
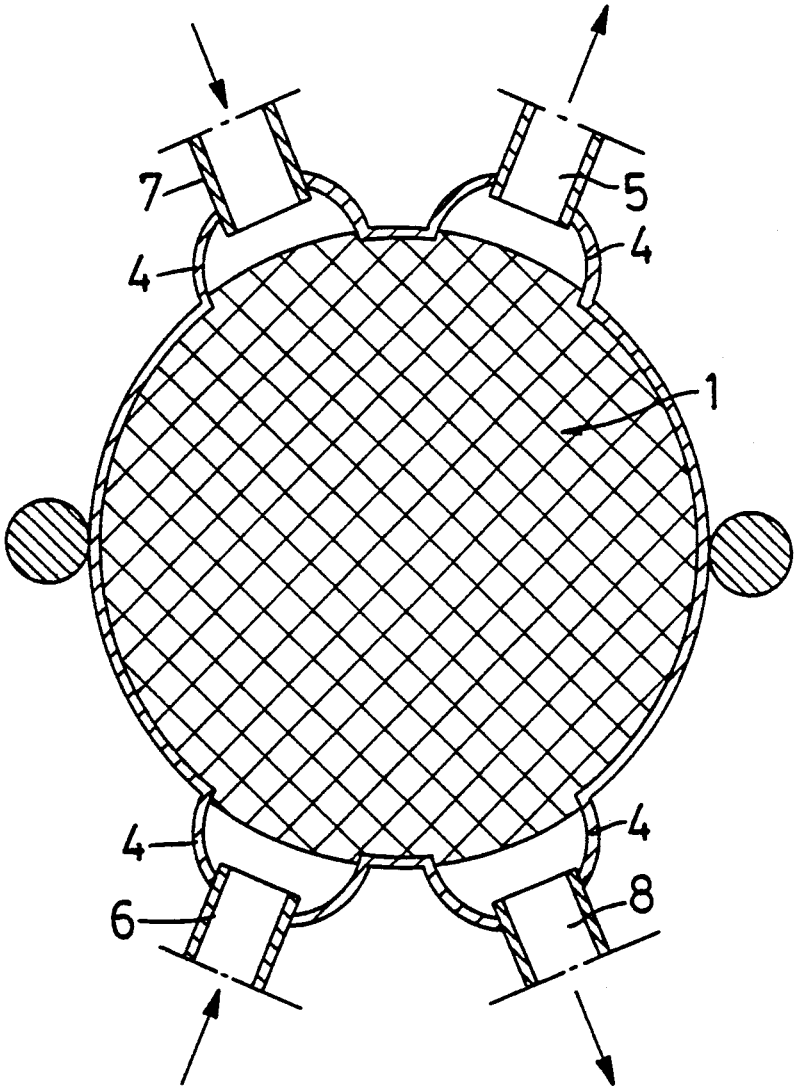

FIG. 7 shows schematically a heat exchanger according to the present invention in which the inlet and outlet chambers of the heat giving and heat receiving mediums are placed at an angle of about 45° to each other but which otherwise correspond to the heat exchanger shown in FIG. 1 and 2.

In FIGS. 1 and 2 is shown a heat exchanger in which the most essential element are circular thermal transmission plates 1 piled on top of each other. Plates 1 have been cut from regularly corrugated plates and they all are identical. As shown in FIG. 2 the plates 1 have been piled one over another in such a way that the corrugations and the grooves between the corrugations in each plate are at an angle of 90° to the corrugations and the grooves in the adjacent plates on both sides of said plate.

The shell of the heat exchanger as shown is partly formed of curved cylindrical sheets 2, to which the thermal transmission plates piled one over another are fastened from their edges, for example, by welding. Another part of the shell is formed of protruding cylindrical sheets 3, which are lying between the first-mentioned cylindrical sheets 2 and which have a smaller radius, the sheets 3 defining on the sides 4 of the heat exchanger four essentially half-cylindrical chambers. With these chambers 4 are connected the inlet and outlet conduits 5, 6 for the heat giving thermal transmission medium and inlet and outlet conduits 7 and 8 for the heat receiving medium. Inside each chamber 4 every second space between the plates of one over another piled thermal transmission plates 1 is open so that the flow can pass from the chambers to these spaces or vice versa, and every second space between the plates is closed so that the medium flow is prevented from getting to these spaces. The spaces open to the heat giving medium have thus been closed from the flow of the heat receiving medium and in the same way the spaces which are open to the flow of the heat receiving medium have been closed from the flow of the heat giving medium. In this way it has been arranged that both the heat giving and the heat receiving medium flows are led via every second space between the plates through the heat exchanger in such a way that they do not mix with each other. Furthermore, the pile of plates is from underside and overside surrounded by end plates 9, which have been fastened to each other by means of drawing rods 10, which are standing on the sides of the pile of plates.

In FIG. 2 the directions of the grooves of the thermal transmission plates 1 which are at an angle of 90° to each other are shown by using unbroken lines 11 and broken lines 12. When the heat exchanger is constructed the directions of these grooves and the angle between them can, however, be chosen freely and so in FIGS. 3 and 4 there are shown two alternative types of heat exchangers, in which the grooves 11 and 12 of the thermal transmission plates 1 piled one over another are directed in a different way from what is shown in FIG. 2. Otherwise these heat exchangers are similar to the heat exchangers shown in FIGS. 1 and 2 and they are constructed by using exactlythe same circular corrugated heat transmission plates.

Figure 5:
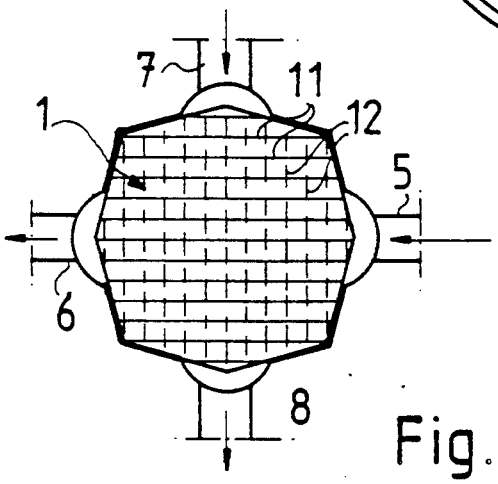
Figure 6:
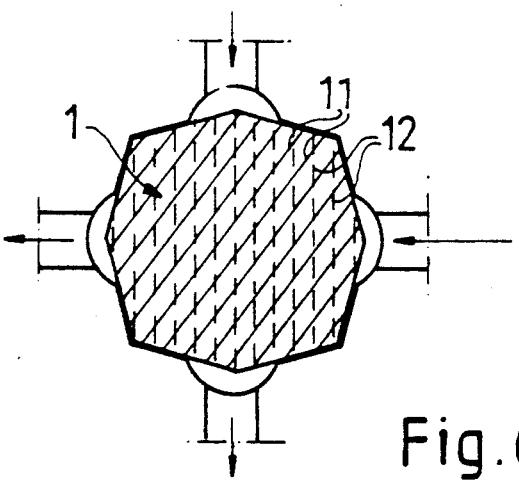

In FIGS. 5 and 6 there are shown two heat exchangers which are examples of plate heat exchangers according to the invention which are constructed by using regular polygonal thermal transmission plates, said two exchangers using thermal transmission plates in the form of regular eight-angled polygons. The thermal transmission plates are in both cases similar and in the heat exchanger shown in FIG. 5 they are piled in such a way that the angle between the grooves 11 and 12 in plates piled on top of each other is 90° and in the heat exchanger in FIG. 6 in such a way that the angle between the grooves 11 and 12 in plates piled on top of each other is 45°.

In the heat exchanger shown in FIG. 2 the inlet and outlet conduits 5., 6. of the heat giving medium and the chambers 4 connected with these conduits have been placed diagonally into the opposite sides, and in the same way the inlet and outlet conduits 7., 8. of the heat receiving medium and the chambers 4 connected with these conduits have been placed diagonally into the opposite sides at an angle of 90° to the former. However, the positions of the conduits and the chambers can be varied, and so in FIG. 7 there is shown an embodiment of the present invention, in which the diagonality of the inlet and outlet conduits of the both mediums has been maintained, but the conduits 7, 8 and the chambers 4 of the heat receiving medium have been turned into an angle of 45° with the conduits 5, 6 and the chambers 4 of the heat giving medium. With respect to the used circular heat transmission plates and their piling the heat exchanger in FIG. 7 corresponds to the one shown in FIGS. 1 and 2.

For a person skilled in the art it is clear that the different embodiments of the invention are not limited to the examples described in the above but may vary within the scope of the following claims. Thus the thermal transmission plates 1 can have a shape other than circular or eight-angled polygonal, e.g. thermal transmission plates in the shape of a regular five-angled polygon can be piled one over another so that the directions of the grooves in the plates become optionally into an angle of 36° or 72° to each other. Furthermore, the possibilities of variations can be increased by cutting polygonal thermal transmission plates from corrugated plates so that the direction of the grooves differs from the directions of the edges of the plates, which is followed by placing at the piling step every second plate in the pile turned upside down.

I claim:

1. A method of constructing a heat exchanger having essentially similar regularly corrugated thermal transmission plates, said transmission plates having corrugations therein, and grooves between said corrugations extending in one direction, in which method the plates are piled to cover each other, and spaces between the plates are from edges of the plates connected with inlet and outlet conduits for flowing mediums participating in thermal transmission, such that through every second of said spaces between the plates is passed a flow of heat giving medium, and through every alternate of said spaces between the plates is passed a flow of heat receiving medium, characterized in that the thermal transmission plates are piled such that the grooves in different plates are disposed in a selected angle with each other, said angle defining pressure losses of the flowing mediums as well as a thermal transmission coefficient, for which purpose there is used in the method plates selected from a group consisting of essentially circular thermal transmission plates and regular polygonal thermal transmission plates with at least five sides in which the direction of the grooves is such that the grooves in said plates cross selectively at least in two different angles with respect to each other, and the heat exchanger is constructed of said thermal transmission plates such that said angle between said grooves in different of said plates may be selected from the range of 0°-90°.

2. The method in accordance with claim 1, characterized in that the thermal transmission plates are joined together at their edges to form a single stationary element.

3. The method in accordance with claim 1, characterized in that on sides of the pile of plates there are formed pairs of chambers which are open to every second space between the plates so that the mediums participating in thermal transmission may pass from the inlet conduits both through their respective chambers to the spaces between the plates and further through their respective chambers to the outlet conduits.

4. The method in accordance with claim 1 characterized in that there are end plates placed under and over the pile of plates, said end plates being fastened to each other by means of drawing rods.

5. A heat exchanger comprising essentially similar thermal transmission plates with corrugations therein and grooves between said corrugations which extend in one direction, said plates being piled on top of each other, and inlet and outlet conduits for mediums participating in thermal transmission, said conduits being connected with edges of the pile of plates such that through every second of spaces between the plates may be passed a flow of heat giving medium and through every alternate of spaces between the plates may be passed a flow of heat receiving medium, characterized in that the thermal transmission plates are selected from a group consisting of essentially circular thermal transmission plates and regular polygonal transmission plates with at least five sides, and are piled in such a way that the grooves in said plates are crosswise with each other, the angle between said grooves in different of said plates being selected from the range of 0°-90°.

6. The heat exchanger in accordance with claim 5, characterized in that the thermal transmission plates are bound to each other at their edges such that the heat exchanger forms a single stationary unit.

7. The heat exchanger in accordance with claim 5 characterized in that on sides of the pile of plates there are pairs of chambers disposed opposite to each other and provided both for the heat giving medium and the heat receiving medium, each chamber being open to every said second space between the plates such that the respective medium flows from the inlet conduits to the spaces between the plates and further to the outlet conduits through their respective chambers.

8. The heat exchanger in accordance with claim 5 characterized in that there are end plates placed at the bottom and top of said pile of plates, said end plates being fastened to each other by means of drawing rods standing on sides of said piles of plates.

* * * * *